United States Patent [19]

Vanier et al.

[11] Patent Number: 4,876,236

[45] Date of Patent: Oct. 24, 1989

[54] MATERIAL FOR INCREASING DYE TRANSFER EFFICIENCY IN DYE-DONOR ELEMENTS USED IN THERMAL DYE TRANSFER

[75] Inventors: Noel R. Vanier, Rochester; Kin K. Lum, Webster, both of N.Y.

[73] Assignee: Eastman Kodak Company, Rochester, N.Y.

[21] Appl. No.: 221,151

[22] Filed: Jul. 19, 1988

Related U.S. Application Data

[63] Continuation-in-part of Ser. No. 129,037, Dec. 4, 1987, abandoned.

[51] Int. Cl.[4] ..... B41M 5/035; B41M 5/26

[52] U.S. Cl. ..... 503/227; 8/471; 428/195; 428/480; 428/913; 428/914

[58] Field of Search ..... 8/470, 471; 427/146, 427/256; 428/195, 480, 913, 914; 503/227

[56] References Cited

U.S. PATENT DOCUMENTS 4,742,042 5/1988 Hiraishi et al. ..... 503/201

FOREIGN PATENT DOCUMENTS 286199 12/1986 Japan ..... 503/227

132676 6/1987 Japan ..... 503/227

*Primary Examiner*—Bruce H. Hess

*Attorney, Agent, or Firm*—Harold E. Cole

[57] ABSTRACT

A dye-donor element for thermal dye transfer comprising a support having on one side thereof a dye dispersed in a polymeric binder, and wherein the polymeric binder comprises a mixed cellulose ester and the dye-donor element contains a colorless, nonpolymeric material for increasing dye transfer efficiency having the following formula:

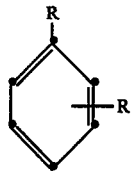

wherein both R groups represent $—CO_2J$ or $—O_2CJ$ and are located either ortho or meta to each other; and each J independently represents a substituted or unsubstituted phenyl group, or a substituted or unsubstituted carbomonocyclic or carbobicyclic ring having from about 5 to about 12 carbon atoms, with the proviso that when either or both of J is substituted, then the total number of substituent carbon atoms in each J group is about 8 or less.

20 Claims, No Drawings

MATERIAL FOR INCREASING DYE TRANSFER EFFICIENCY IN DYE-DONOR ELEMENTS USED IN THERMAL DYE TRANSFER

This application is a continuation-in-part of U.S. application Ser. No. 129,037 filed Dec. 4, 1987, now abandoned.

This invention relates to materials which can be added to a dye-doner element in order to improve the dye transfer efficiency.

In recent years, thermal transfer systems have been developed to obtain prints from pictures which have been generated electronically from a color video camera. According to one way of obtaining such prints, an electronic picture is first subjected to color separation by color filters. The respective color-separation images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

It is always desirable to transfer as much dye as possible with the lowest thermal energy in dye transfer systems using a thermal head. The amount of dye which can be transferred from a dye-donor to a receiving element by thermal dye transfer depends upon the dye transfer efficiency. There are compounds which have been added to the dye-donor in order to increase the dye transfer efficiency which would enable a given amount of dye to be transferred with less energy. However, these compounds have suffered from one or more shortcomings. For example, some compounds which have been tried cause crystallization of the dye. Other compounds have a beneficial effect on dye transfer initially, but lose that effect upon storage of the dye-donor.

In JP No. 62/132,676, there is a disclosure of compounds described as "diffusion promoters". These compounds are coated in a blank frame or blank patch of a dye-donor element by themselves, separate from the dye patches.

There are problems with having such a diffusion-promoting material coated in a blank patch separate from the dye patch. Such a procedure would necessitate a separate heating step during processing in order to apply the material to the receiver. There would also be additional manufacturing costs involved in coating the material separately from the dye, as well as additional costs in the thermal transfer of such material.

In JP No. 61/286,199, there is a disclosure of a dye-donor element containing a "heat-fusible" compound of a certain formula. In Example 1 of that reference, benzoic acid phenyl ester is employed in a binder of ethyl cellulose and in Example 3, similar compounds are employed in a binder of cellulose acetate. As will be shown by comparative tests hereinafter, the use of a cellulose acetate binder with the compounds employed in this invention gives poor transfer density and the use of an ethyl cellulose binder gives poor density after incubation. In addition, as will be shown by comparative tests hereinafter, not all the compounds shown in the JP No. 61/286,199 reference provide a significant increase in density upon transfer.

It would be desirable to provide a way to employ a material to increase dye transfer efficiency without having to coat it separately from the dye layer. It would also be desirable to provide such a material which would not promote crystallization of the dye in the dye-donor and which would retain its beneficial effects upon storage.

These and other objects are achieved in accordance with this invention which comprises a dye-donor element for thermal dye transfer comprising a support having on one side thereof a dye dispersed in a polymeric binder, and wherein the polymeric binder comprises a mixed cellulose ester and the dye-donor element contains a colorless, nonpolymeric material for increasing dye transfer efficiency having the following formula:

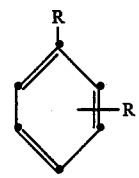

wherein both R groups represent $—CO_2J$ or $—O_2CJ$ and are located either ortho or meta to each other; and each J independently represents a substituted (e.g., alkyl, alkoxy, acyl, etc.) or unsubstituted phenyl group, or a substituted (e.g., alkyl, alkoxy, acyl, etc.) or unsubstituted carbomonocyclic or carbobicyclic ring having from about 5 to about 12 carbon atoms, with the proviso that when either or both of J is substituted, then the total number of substituent carbon atoms in each J group is about 8 or less.

These compounds provide an increase in dye transfer efficiency by providing equivalent density with less energy than a dye-donor which does not contain the compounds.

The phenyl group in the above formula may be substituted with groups such as $CH_3$, $C_2H_5$, $t—C_4H_9$, $OC_2H_5$, $CH_2OCH_3$, $COCH_3$, $NO_2$, etc.

As noted above, the polymeric binder employed in the invention comprises a mixed cellulose ester. Such esters include cellulose acetate propionate, cellulose acetate butyrate, cellulose acetate hydrogen phthalate, etc. In a preferred embodiment of the invention, the binder is cellulose acetate propionate or cellulose acetate butyrate. The binder may be used at a coverage of from about 0.1 to about 5 $g/m^2$.

In another preferred embodiment of the invention, both R groups represent $—O_2CJ$ and J is phenyl.

In still another preferred embodiment of the invention, both R groups represent $—CO_2J$, wherein J represents $-C_6H_5$, cyclo-$C_6H_{11}$, $—C_6H_4(4\text{-}OCCH_3)$, $—C_6H_4$-

(3—$OCH_3$), -$C_6H_4$(3—$CH_3$), —$C_6H_4$(2,6—t—$C_4H_9$), —$C_6H_4$(2,6—i—$C_3H_7$), or fenchyl.

In yet still another preferred embodiment of the invention, the material for increasing the dye transfer efficiency has the formula:

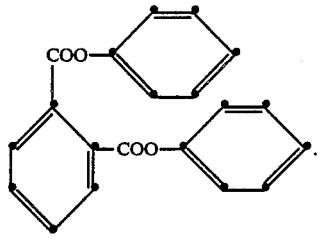

The materials described above may be incorporated directly into the dye layer of the dye-donor or in an adjacent layer where it will be in effective contact with the dye. The material may be employed in any amount which is effective for the intended use. In general, good results have been obtained at a concentration of from about 0.05 to about 0.3 g/$m^2$ or about 30% to about 300% by weight of coated dye.

Compounds included within the scope of the invention include the following:

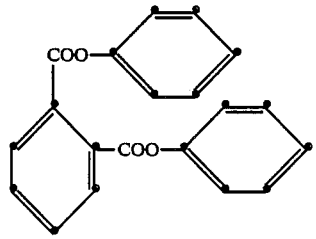

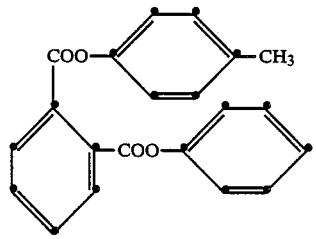

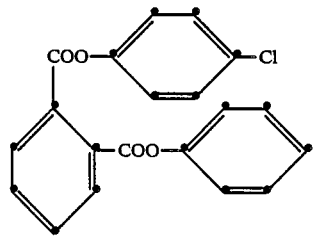

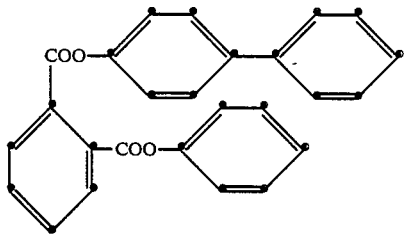

-continued

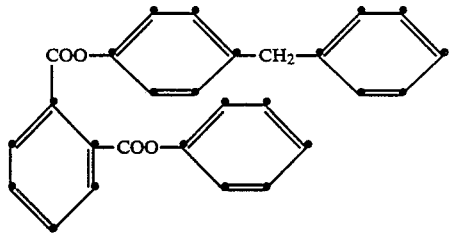

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co., Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

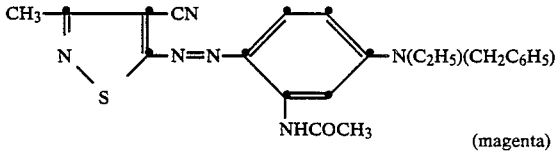

(magenta)

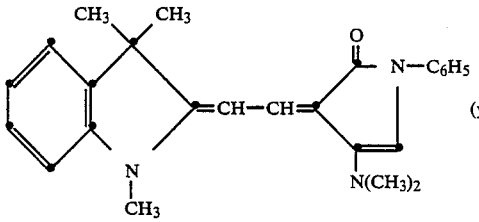

(yellow)

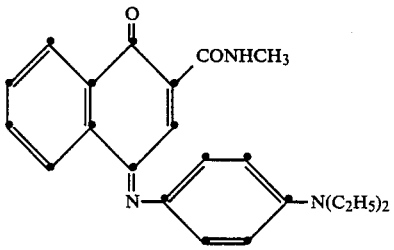

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye layer of the dye-donor element may be coated on the support or printed thereon by a printing technique such as a gravure process.

A dye-barrier layer may be employed in the dye-donor elements of the invention to improve the density of the transferred dye. Such dye-barrier layer materials include hydrophilic materials such as those described and claimed in U.S. Pat. No. 4,700,208 by Vanier, Lum and Bowman, issued Oct. 13, 1987.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymetylene; polyacetals; polyolefins such as polystyrene, polyethylene, polypropylene or methylpentane polymers; and polyimides such as polyimide-amides and polyether-imides. The support generally has a thickness of from about 2 to about 30 μm. It may also be coated with a subbing layer, if desired.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711 of Vanier, Harrison and Kan and 4,717,712 of Harrison, Vanier and Kan; and U.S. application Ser. Nos. 076,433 of Henzel, Lum and Vanier, filed July 21, 1987, 062,796 of Vanier and Evans, filed June 16, 1987, and 062,797 of Henzel and Vanier, filed June 16, 1987. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about .001 to about 2 g/m$^2$. If a polymeric binder is employed, the lubricating material is present in the range of 0.1 to 50 weight %, preferably 0.5 to 40, of the polymeric binder employed.

The dye-receiving element that is used with the dye-donor element of the invention usually comprises a support having thereon a dye imagereceiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®. In a preferred embodiment, polyethylene-coated paper is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor element of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651 of Moore, Weaver and Lum; 4,695,287 of Evans and Lum; and 4,701,439 of Weaver, Moore and Lum; and U.S. application Ser. Nos. 059,442 of Byers and Chapman, filed June 8, 1987; 059,443 of Evans and Weber, filed June 8, 1987; 095,796 of Evans and Weber, filed Sept. 14, 1987; and 123,441 of Byers, Chapman and McManus, filed Nov. 20, 1987, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1—COMPARATIVE TESTS

A dye-receiver was prepared by obtaining a commercially produced paper stock 6.5 mil (165 μm) thick 40 lb/1000 ft$^2$ (195 g/m$^2$) mixture of hard woodkraft and soft wood-sulfite bleached pulp. The paper stock was then extrusion overcoated with an approximately 1:4 ratio of medium density:high density polyethylene (2.5 lb/1000 ft$^2$) (12 g/m$^2$) with approximately 6 wt. percent anatase titanium dioxide and 1.5 wt. percent zinc oxide (layer thickness 12 μm). The support was then coated with the following layers:

(a) Subbing layer of poly(acrylonitrile)-co-vinylidene chloride-co-acrylic acid (14:79:7 wt. ratio) (0.54 g/m$^2$) coated from a butanone and cyclopentanone solvent mixture;

(b) Dye-receiving layer of Makrolon 5705 ® polycarbonate (Bayer AG) (2.9 g/m$^2$), 1,4-didecoxy-2,5-dimethoxybenzene (0.38 g/m$^2$), and polycaprolactone (0.38 g/m$^2$) coated from methylene chloride; and (c) Overcoat of polycaprolactone (0.11 g/m$^2$), DC 510 ® (Dow Corning Corp.) surfactant (0.011 g/m$^2$) and FC-431 ® surfactant (3M Co.) (0.011 g/m$^2$) coated from methylene chloride.

The back side of the receiver was coated with a polyethylene layer and an overcoat layer.

Control cyan, magenta and yellow dye-donor elements were prepared as follows. On one side of a 6 μm poly(ethylene terephthalate) support, a subbing layer of titanium n-butoxide (duPont Tyzor TBT ®) (0.12 g/m$^2$) was coated from a n-propyl acetate and 1-butanol solvent mixture. On top of this layer were coated repeating color patches of cyan, magenta and yellow dyes. The cyan coating contained the cyan dye illustrated above (0.28 g/m$^2$) and cellulose acetate propionate (2.5% acetyl, 45% propionyl) binder (0.44 g/m$^2$) from a toluene, methanol and cyclopentanone solvent mixture. The magenta coating contained the magenta dye illustrated above (0.15 g/m$^2$) in the same binder as the cyan dye (0.32 g/m$^2$). The yellow coating contained the yellow dye illustrated above (0.14 g/m$^2$) in the same binder as the cyan dye (0.25 g/m$^2$).

Dye-donor elements in accordance with the invention were prepared similar to the control element except that they also contained either 0.054 g/m$^2$ or 0.16 g/m$^2$ of diphenyl phthalate.

Comparison dye-donor elements were made similar to the control elements except that they contained plasticizer compounds as listed in Table 1.

On the reverse side of each dye-donor was coated a subbing layer of Tyzor TBT ® titanium n-butoxide (duPont Corp.) (0.12 g/m$^2$) coated from n-propyl acetate and 1-butanol solvent mixture and a slipping layer of Emralon 329 ® (Acheson Colloids Co.) lubricant (0.54 g/m$^2$) of poly(tetrafluoroethylene) particles in a cellulose nitrate binder and a propyl acetate, toluene, isopropyl alcohol and 2-butanone solvent mixture.

The dye-side of the dye-donor element strip 4 inches (10. cm) wide was placed in contact with the dye image-receiving layer of a dye-receiver element strip of the same width. The assemblage was fastened in a clamp on a rubber-roller of 2.25 in (5.65 cm) diameter driven by a stepper motor. A TDK L-231 Thermal Head was pressed at a force of 8 pounds (3.6 kg) against the dye-donor element side of the assemblage pushing it against the rubber roller.

The imaging electronics were activated causing the device to draw the assemblage between the printing head and roller at 0.25 inches/sec (6.4 mm/sec). Coincidentally the resistive elements in the thermal print were heated using a supplied voltage of approximately 25.5 v, representing approximately 0.36 watts/pixel (8.5 mjoules/pixel group) at Dmax.

Graduated density test images were generated using a "pulse-imaging" technique as described in the Brownstein patent referred to above. The energy required to produce a 1.0 density image was calculated. In this manner, the relative efficiency of thermal transfer (energy for 1.0 density) can be efficiently compared.

Each dye-donor was then incubated for 2 weeks at 49° C., 50% RH. The imaging test was then repeated to re-evaluate the thermal transfer efficiency (energy for 1.0 density). The following results were obtained:

TABLE 1

| Material Added to Dye Donor @ 0.054 g/m$^2$ | Energy (mjoules/pixel)/1.0 density | | | | | |
|---|---|---|---|---|---|---|
| | Blue | | Green | | Red | |
| | Init. | Inc. | Init. | Inc. | Init. | Inc. |
| None (Control) | 5.3 | 5.4 | 5.6 | 5.8 | 5.6 | 5.8 |
| A (Comparison) | 4.9 | 5.4 | 5.1 | 5.8 | 5.1 | 5.7 |
| B (Comparison) | 5.1 | 5.5 | 5.4 | 5.8 | 5.4 | 5.8 |
| C (Comparison) | 5.1 | 5.5 | 5.3 | 5.7 | 5.2 | 5.7 |
| D (Comparison) | 5.2 | 5.5 | 5.5 | 5.8 | 5.4 | 5.8 |
| Diphenyl phthalate | 4.9 | 5.1 | 5.1 | 5.3 | 5.2 | 5.4 |
| **Material Added to Dye-Donor @ 0.16 g/m$^2$** | **Energy (mjoules/pixel)/1.0 density** | | | | | |
| | Blue | | Green | | Red | |
| | Init. | Inc. | Init. | Inc. | Init. | Inc. |
| None (Control) | 5.3 | 5.4 | 5.6 | 5.8 | 5.6 | 5.8 |
| A (Comparison) | 4.2 | 5.4 | 4.6 | 5.5 | 4.6 | 5.7 |
| B (Comparison) | 4.8 | 5.3 | 5.2 | 5.6 | 4.9 | 5.6 |
| C (Comparison) | 4.3 | 5.4 | 4.7 | 5.7 | 4.6 | 5.2 |
| E (Comparison) | 5.1 | 5.5 | 5.4 | 5.9 | 5.5 | 5.8 |
| Diphenyl phthalate | 4.0 | 4.1 | 4.3 | 4.3 | 4.8 | 4.9 |

Compound A is 1,3-diphenyl-2-propanone.
Compound B is diphenyl carbonate.
Compound C is benzyl benzoate.
Compound D is diphenyl methane.
Compound E is bibenzyl.

The above results indicate that although the comparison dye-donor elements initially provided equivalent density with less energy than the control, this benefit was lost when the coatings were incubated. The dye-donor element of the invention, however, remained relatively unchanged (less than 0.2 mjoules) in producing a 1.0 density image before and after incubation of the dye-donor.

EXAMPLE 2—CELLULOSIC BINDER COMPARISONS

A magenta dye-donor element was prepared by coating on a 6 μm poly(ethylene terephthalate) support:

(1) a subbing layer of a titanium alkoxide (duPont Tyzor TBT ®) (0.12 g/m$^2$) coated from a n-propyl acetate and n-butyl alcohol solvent mixture, and (2) a dye layer containing the magenta dye illustrated above (0.17 g/m$^2$) in the cellulosic binder indicated below at either 0.26 or 0.34 g/m$^2$ coated from a toluene, methanol and cyclopentanone solvent mixture, and diphenyl phthalate (0.09 to 1.7 g/m$^2$).

On the back side of the dye-donor was coated:

(1) a subbing layer of a titanium alkoxide (duPont Tyzor TBT ®) (0.12 g/m$^2$) coated from a n-propyl acetate and n-butyl alcohol solvent mixture, and (2) a slipping layer of Petrarch Systems PS513® amino-terminated polysiloxane (0.004 g/m²); p-toluenesulfonic acid (2.5% of the wt. of the polysiloxane); Emralon 329® (Acheson Colloids Corp.) dry film lubricant of poly(tetrafluoroethylene) particles in a cellulose nitrate resin binder (0.54 g/m²); and BYK-320® (BYK Chemie, USA) copolymer of a polyalkylene oxide and a methyl alkylsiloxane (0.0075 g/m²), coated from a n-propyl acetate, toluene, isopropyl alcohol and n-butyl alcohol solvent mixture.

A dye-receiver was prepared by obtaining a commercially produced paper stock 6.5 mil (165 μm) thick 40 lb/1000 ft² (195 g/m²) mixture of hard woodkraft and soft wood-sulfite bleached pulp. The paper stock was then extrusion overcoated with an approximately 1:4 ratio of medium density:high density polyethylene (2.5 lb/1000 ft²) (12 g/m²) with approximately 6 wt. percent anatase titanium dioxide and 1.5 wt. percent zinc oxide (layer thickness 12 μm). The support was then coated with the following layers:

(a) Subbing layer of poly(acrylonitrile)-co-vinylidene chloride-co-acrylic acid (14:79:7 wt. ratio) (0.54 g/m²) coated from a butanone and cyclopentanone solvent mixture; and (b) Dye-receiving layer of Makrolon 5705® polycarbonate (Bayer AG) (2.9 g/m²), 1,4-didecoxy-2,5-dimethoxybenzene (0.38 g/m²), and FC-431® (3M Corp.) surfactant (0.016 g/m²) coated from methylene chloride.

The dye side of the dye-donor element strip approximately 10 cm x 13 cm in area was placed in contact with the dye image-receiving layer of the dye-receiver element of the same area. The assemblage was clamped to a stepper-motor driven 60 mm diameter rubber roller and a TDK Thermal Head (No. L-231) (thermostatted at 26° C.) was pressed with a force of 8.0 pounds (3.6 kg) against the dye-donor element side of the assemblage pushing it against the rubber roller.

The imaging electronics were activated causing the donor/receiver assemblage to be drawn between the printing head and roller at 6.9 mm/sec. Coincidentally, the resistive elements in the thermal print head were pulsed for 29 μsec/pulse at 128 μsec intervals during the 33 msec/dot printing time. A stepped density image was generated by incrementally increasing the number of pulses/dot from 0 to 255. The voltage supplied to the print head was approximately 23.5 volts, resulting in an instantaneous peak power of 1.3 watts/dot and a maximum total energy of 9.6 mjoules/dot.

The dye-receiver was separated from the dye-donor and the Status A green densities of each transferred image consisting of a series of eight graduated density steps one cm square were read, and the maximum density, D-max, was tabulated. Another portion of each dye-donor was incubated at 49° C., approximately 50% RH for 7 days. The same imaging procedure described above was used for these incubated donors and D-max values were compared. The percent density loss from D-max was calculated. The following results were obtained.

TABLE 2

| Diphenyl phthalate (g/m²) | Binder (g/m²) | Status A Green D-max Fresh | Incub. |
|---|---|---|---|
| None (Control) | CAP (0.26) | 2.9 | 2.9 |
| 0.09 | CAP (0.26) | 3.3 | 3.1 |
| 0.17 | CAP (0.26) | 3.3 | 2.9 |

TABLE 2-continued

| Diphenyl phthalate (g/m²) | Binder (g/m²) | Status A Green D-max Fresh | Incub. |
|---|---|---|---|
| None (Control) | CAP (0.34) | 2.7 | 2.5 |
| 0.09 | CAP (0.34) | 3.0 | 2.8 |
| 0.17 | CAP (0.34) | 3.2 | 2.9 |
| None (Control) | CAB (0.26) | 3.1 | 3.2 |
| 0.09 | CAB (0.26) | 3.5 | 3.3 |
| 0.17 | CAB (0.26) | 3.6 | na* |
| None (Control) | CAB (0.34) | 2.8 | 2.9 |
| 0.09 | CAB (0.34) | 3.2 | 3.3 |
| 0.17 | CAB (0.34) | 3.5 | 3.1 |
| Comparison Binders | | | |
| None (Control) | CA (0.26) | 0.8 | 0.8 |
| 0.09 | CA (0.26) | 1.0 | 1.1 |
| 0.17 | CA (0.26) | 1.7 | 1.8 |
| None (Control) | CA (0.34) | 0.7 | 0.7 |
| 0.09 | CA (0.34) | 0.9 | 0.9 |
| 0.17 | CA (0.34) | 1.0 | 1.4 |
| None (Control) | EC (0.26) | 3.3 | 3.2 |
| 0.09 | EC (0.26) | 3.4 | 2.2 |
| 0.17 | EC (0.26) | 3.3 | 2.3 |
| None (Control) | EC (0.34) | 3.1 | 3.2 |
| 0.09 | EC (0.34) | 3.3 | 2.8 |
| 0.17 | EC (0.34) | 3.3 | 1.8 |

CAP = cellulose acetate propionate (2.5% acetyl, 45% propionyl)
CAB = cellulose acetate butyrate (2.0% acetyl, 47% butyryl)
CA = cellulose acetate (40.0% acetyl)
EC = ethyl cellulose
*na = not available The above results show that only dye-donors that employ diphenylphthalate and use binders of mixed cellulose esters in accordance with the invention gave an initial increase in transferred dye density that was maintained upon dye-donor incubation. The comparison binder of cellulose acetate gave low transferred densities regardless of whether the dye-donor was fresh or incubated. The comparison binder of ethyl cellulose showed increase dye transfer when fresh, but this was not maintained upon incubation of the dye-donor.

EXAMPLE 3

A magenta dye-donor element was prepared by coating on a 6 μm poly(ethylene terephthalate) support:

(1) a subbing layer of a titanium alkoxide (duPont Tyzor TBT®) (0.12 g/m²) coated from a n-propyl acetate and n-butyl alcohol solvent mixture, and (2) a dye layer containing the magenta dye illustrated above (0.17 g/m²) in a cellulose acetate propionate binder (2.5% acetyl, 45% propionyl) (0.31 g/m²) coated from a toluene, methanol and cyclopentanone solvent mixture, and the aromatic ester indicated in Tables 3 and 4 (0.17 g/m²).

On the back side of the dye-donor was coated:

(1) a subbing layer of titanium alkoxide (duPont Tyzor TBT®)(0.12 g/m²) coated from a n-propyl acetate and n-butyl alcohol solvent mixture, and (2) a slipping layer containing the following material for Sets A, B, and D: Emralon 329® (Acheson Colloids Corp.) dry film lubricant of poly(tetrafluoroethylene) particles in a cellulose nitrate resin binder (0.54 g/m²), coated from a n-propyl acetate, toluene, isopropyl alcohol and n-butyl alcohol solvent mixture; For Set C, the same as Sets A, B, and D but also containing Petrarch Systems PS513® amino-terminated polysiloxane (0.004 g/m²); p-toluenesulfonic acid (2.5% of the wt. of the polysiloxane); and BYK-320® (BYK Chemie, USA) copolymer of a polyalkylene oxide and a methyl alkylsiloxane (0.008 g/m²); For Set E, the same as Sets A, B and D, but also containing S-232® wax (Shamrock Technologies) (micronized blend of polyethylene and carnauba wax particles (0.016 g/m$^2$).

The dye-donors were then incubated for 7 days at 49° C., 50% RH.

The dye-receiver of Example 2 was employed in this Example.

The dye side of the dye-donor element strip approximately 10 cm × 13 cm in area was placed in contact with the dye image-receiving layer of the dye-receiver element of the same area. The assemblage was clamped to a stepper-motor driven 60 mm diameter rubber roller and TDK Thermal Head (No. L-231) (thermostatted at 26° C.) was pressed with a force of 8.0 pounds (3.6 kg) against the dye-donor element side of the assemblage pushing it against the rubber roller.

The imaging electronics were activated causing the donor/receiver assemblage to be drawn between the printing head and roller at 6.9 mm/sec. Coincidentally, the resistive elements in the thermal print head were pulsed for 29 μsec/pulse at 128 μsec intervals during the 33 msec/dot printing time. Graduated density test images were generated using a "pulsed-imaging" technique as described in U.S. Pat. No. 4,621,271 of Brownstein referred to above. Pulses/dot were incrementally increased from 0 to 255. The voltage supplied to the print head was approximately 23.5 volts, resulting in an instantaneous peak power of 1.3 watts/dot and a maximum total energy of 9.6 mjoules/dot.

The dye-receiver was separated from the dye-donor and the Status A green densities of each transferred image consisting of a series of eleven graduated density steps one cm square were read, and the maximum density, D-max, was tabulated. The energy (number of pulses) required to produce a density of 2.0 was also calculated. In this manner, the relative efficiency of thermal dye transfer (pulses for 2.0 density) can be effectively compared.

In general, materials suitable for the practice of the invention had to produce a 2.0 density after donor incubation with at least 5% less energy (approximately 12–15 pulses less) and not show a maximum density loss greater than 0.5 as compared to a control with no material added. The following results were obtained.

TABLE 3

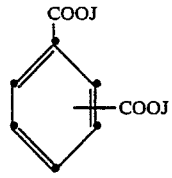

| | | | Pulses/D = 2.0 | | D-max | |
|---|---|---|---|---|---|---|
| Set | Isomer | J | Obs. | Δ Cont. | Obs. | Δ Cont. |
| Comparisons | | | | | | |
| A | None (control) | | 211 | — | 3.0 | — |
| A | 1,2 | $-CH_3$ | 233 | +22 | 2.0 | −1.0 |
| A* | 1,2 | $-CH_3$ | 223 | +12 | 2.1 | −0.9 |
| A | 1,3 | $-CH_3$ | 216 | +05 | 2.2 | −0.8 |
| A | 1,4 | $-CH_3$ | 211 | 0 | 2.2 | −0.8 |
| A | 1,2 | $-C_2H_5$ | 199 | +12 | 2.5 | −0.5 |
| A | 1,2 | $-C_4H_9$ | ** | 0 | 1.7 | −1.3 |
| A | 1,2 | $-C_{10}H_{21}$ | ** | 0 | 0.7 | −2.3 |
| Invention | | | | | | |
| A | 1,2 | $-C_6H_5$ | 192 | −19 | 2.8 | −0.2 |
| A | 1,2 | $-C_6H_{11}$(cyclo) | 190 | −21 | 2.7 | −0.3 |
| Comparisons | | | | | | |
| B | None (control) | | 236 | — | 2.5 | — |
| B | 1,4 | $-C_6H_5$ | 238 | +02 | 2.4 | −0.1 |
| B | 1,2 | $-C_6H_4(3\text{-}O_2CC_6H_5)$ | 228 | −08 | 2.7 | +0.2 |
| B | 1,2 | $-C_6H_3(2\text{-}COC_6H_5, 5\text{-}OCH_3)$ | 233 | −03 | 2.6 | +0.1 |
| Invention | | | | | | |
| B | 1,2 | $-C_6H_5$ | 201 | −35 | 3.1 | +0.6 |
| B | 1,3 | $-C_6H_5$ | 207 | −29 | 3.0 | +0.5 |
| B | 1,2 | $-C_6H_4(4\text{-}O_2CCH_3)$ | 216 | −20 | 3.0 | +0.5 |
| Comparisons | | | | | | |
| C | None (control) | | 230 | — | 2.8 | — |
| C | 1,3 | $-C_{10}H_7$(naphthyl) | 226 | −04 | 2.9 | +0.1 |
| Invention | | | | | | |
| C | 1,2 | $-C_6H_5$ | 221 | −09 | 2.4 | −0.4 |
| C | 1,3 | $-C_6H_4(3\text{-}OCH_3)$ | 213 | −17 | 2.9 | +0.1 |
| D | None (control) | | 221 | — | 2.9 | — |
| Invention | | | | | | |
| D | 1,2 | $-C_6H_5$ | 199 | −22 | 2.8 | −0.1 |
| D | 1,3 | $-C_6H_4(3\text{-}CH_3)$ | 199 | −22 | 2.7 | −0.2 |
| Comparisons | | | | | | |
| E | None (control) | | 236 | — | 2.5 | — |
| E | 1,2 | $-C_6H_4(2,6\text{-}t\text{-}C_5H_{11})$ | 230 | −06 | 2.5 | 0 |
| Invention | | | | | | |
| E | 1,2 | $-C_6H_4(2,6\text{-}t\text{-}C_4H_9)$ | 223 | −13 | 2.8 | +0.3 |
| E | 1,3 | $-C_6H_4(2,6\text{-}t\text{-}C_4H_9)$ | 226 | −10 | 2.6 | +0.1 |
| E | 1,2 | $-C_6H_4(2,6\text{-}i\text{-}C_3H_7)$ | 214 | −22 | 2.9 | +0.4 |
| E | 1,2 | $-C_6H_5$ | 201 | −35 | 2.9 | +0.4 |

TABLE 3-continued

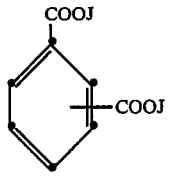

| Set | Isomer | J | Pulses/D = 2.0 Obs. | Pulses/D = 2.0 Δ Cont. | D-max Obs. | D-max Δ Cont. |
|---|---|---|---|---|---|---|
| E | 1,2 | $-C_{10}H_{17}$(fenchyl) | 221 | −15 | 2.8 | +0.3 |

*Contained 4-$NO_2$ on the phenyl ring
**Pulses not measured since density of 2.0 was not obtained.

TABLE 4

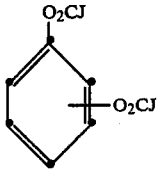

| Set | Isomer | J | Pulses/D = 2.0 Obs. | Pulses/D = 2.0 Δ Cont. | D-max Obs. | D-max Δ Cont. |
|---|---|---|---|---|---|---|
| B | None (control) | | 236 | — | 2.6 | — |
| B | 1,4 | $-C_6H_5$ | 233 | −03 | 2.7 | +0.1 |
| B* | 1,2 | $-C_6H_5$ | 202 | −34 | 3.2 | +0.6 |
| B | 1,3 | $-C_6H_5$ | 206 | −30 | 3.0 | +0.4 |

*Contained 3-$CH_3$ on the phenyl ring

The above results indicate that materials used in accordance with the invention produced at least a 2.0 density after donor incubation, with at least 5% less energy (approximately 12–15 pulses less), without showing a maximum density loss greater than 0.5 as compared to a control with no material added.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having on one side thereof a dye dispersed in a polymeric binder, the improvement wherein said polymeric binder comprises a mixed cellulose ester and said dye-donor element contains a colorless, nonpolymeric material for increasing dye transfer efficiency having the following formula:

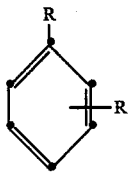

wherein both R groups represent $-CO_2J$ or $-O_2CJ$ and are located either ortho or meta to each other; and each J independently represents a substituted or unsubstituted phenyl group, or a substituted or unsubstituted carbomonocyclic or carbobicyclic ring having from 5 to about 12 carbon atoms, with the proviso that when either or both of J is substituted, then the total number of substituent carbon atoms in each J group is 8 or less.

2. The element of claim 1 wherein both R groups represent $-O_2CJ$ and J is phenyl.

3. The element of claim 1 wherein said polymeric binder comprises cellulose acetate propionate or cellulose acetate butyrate.

4. The element of claim 1 wherein both R groups represent $-CO_2J$.

5. The element of claim 4 wherein said J represents $-C_6H_5$, cyclo-$C_6H_{11}$, $-C_6H_4(4-OCCH_3)$, $-C_6H_4(3-OCH_3)$, $-C_6H_4(3-CH_3)$, $-C_6H_4(2,6-t-C_4H_9)$, $-C_6H_4(2,6-i-C_3H_7)$, or fenchyl.

6. The element of claim 1 wherein said material has the formula:

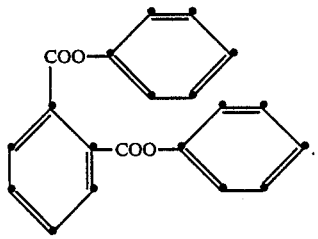

7. The element of claim 1 wherein said support comprises poly(ethylene terephthalate) and the dye layer comprises sequential repeating areas of cyan, magenta and yellow dye.

8. In a process of forming a dye transfer image comprising imagewise-heating a dye-donor element comprising a support having on one side thereof a dye layer comprising a dye dispersed in a polymeric binder and transferring a dye image to a dye-receiving element to form said dye transfer image, the improvement wherein said polymeric binder comprises a mixed cellulose ester and said dye-donor element contains a colorless, nonpolymeric material for increasing dye transfer efficiency having the following formula:

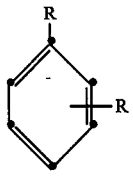

wherein both R groups represent $-CO_2J$ or $-O_2CJ$ and are located either ortho or meta to each other; and each J independently represents a substituted or unsubstituted phenyl group, or a substituted or unsubstituted carbomonocyclic or carbobicyclic ring having from 5 to about 12 carbon atoms, with the proviso that when either or both of J is substituted, then the total number of substituent carbon atoms in each J group is 8 or less.

9. The process of claim 8 wherein both R groups represent $—O_2CJ$ and J is phenyl.

10. The process of claim 8 wherein said polymeric binder comprises cellulose acetate propionate or cellulose acetate butyrate.

11. The process of claim 8 wherein both R groups represent $—CO_2J$.

12. The process of claim 11 wherein said J represents $—C_6H_5$, cyclo-$C_6H_{11}$, $—C_6H_4(4—OCCH_3)$, $—C_6H_4(3—OCH_3)$, $—C_6H_4(3\text{-}CH_3)$, $—C_6H_4(2,6—t\text{-}C_4H_9)$, $—C_6H_4(2,6—i\text{-}C_3H_7)$, or fenchyl.

13. The process of claim 8 wherein said material has the formula:

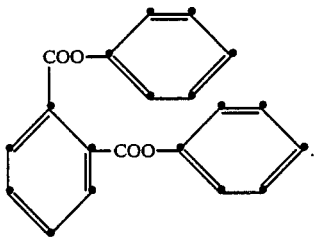

14. The process of claim 8 wherein said support is poly(ethylene terephthalate) which is coated with sequential repeating areas of cyan, magenta and yellow dye and said process steps are sequentially performed for each color to obtain a three-color dye transfer image.

15. In a thermal dye transfer assemblage comprising:

(a) a dye-donor element comprising a support having on one side thereof a dye layer comprising a dye dispersed in a polymeric binder, and (b) a dye-receiving element comprising a support having thereon a dye image-receiving layer, said dye-receiving element being in a superposed relationship with said dye-donor element so that said dye layer is in contact with said dye image-receiving layer, the improvement wherein said polymeric binder comprises a mixed cellulose ester and said dye-donor element contains a colorless, nonpolymeric material for increasing dye transfer efficiency having the following formula:

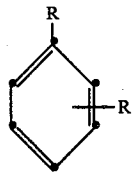

wherein both R groups represent $—CO_2J$ or $O_2CJ$ and are located either ortho or meta to each other; and each J independently represents a substituted or unsubstituted phenyl group, or a substituted or unsubstituted carbomonocyclic or carbobicyclic ring having from 5 to about 12 carbon atoms, with the proviso that when either or both of J is substituted, then the total number of substituent carbon atoms in each J group is 8 or less.

16. The assemblage of claim 15 wherein both R groups represent $—O_2CJ$ and J is phenyl.

17. The assemblage of claim 15 wherein said polymeric binder comprises cellulose acetate propionate or cellulose acetate butyrate.

18. The assemblage of claim 15 wherein both R groups represent $-CO_2J$.

19. The assemblage of claim 18 wherein said J represents $—C_6H_5$, cyclo-$C_6H_{11}$, $—C_6H_4(4—OCCH_3)$, $—C_6H_4(3—OCH_3)$, $—C_6H_4(3—CH_3)$, $—C_6H_4(2,6—t\text{-}C_4H_9)$, $—C_6H_4(2,6—i\text{-}C_3H_7)$, or fenchyl.

20. The assemblage of claim 15 wherein said material has the formula:

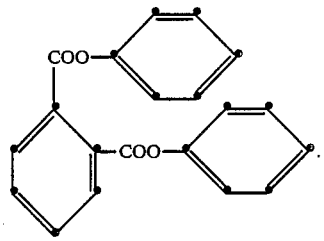

* * * * *